US007351159B2

(12) United States Patent
Lai

(10) Patent No.: US 7,351,159 B2
(45) Date of Patent: Apr. 1, 2008

(54) COMPLEX HOSEL STRUCTURE FOR A GOLF CLUB HEAD HAVING A HIGH DEGREE OF VIBRATIONAL ABSORBABILITY AND ELASTIC DEFORMABILITY

(75) Inventor: Yuan-Hung Lai, Kaohsiung (TW)

(73) Assignees: Fu Sheng Industrial Co., Ltd., Taipei (TW); Nelson Precision Casting Co., Ltd., Kaohsiung (TW)

( * ) Notice: Subject to any disclaimer, the term of this patent is extended or adjusted under 35 U.S.C. 154(b) by 0 days.

(21) Appl. No.: 11/350,870

(22) Filed: Feb. 10, 2006

(65) Prior Publication Data

US 2007/0191133 A1 Aug. 16, 2007

(51) Int. Cl.
*A63B 53/02* (2006.01)

(52) U.S. Cl. ..... 473/305; 473/332

(58) Field of Classification Search ..... 473/305–307, 473/288, 332, 349, 309
See application file for complete search history.

(56) References Cited

U.S. PATENT DOCUMENTS 1,850,843 A * 3/1932 Lagerblade ..... 29/525.06
4,555,115 A * 11/1985 You ..... 473/343
4,995,609 A 2/1991 Parente et al.
5,348,777 A * 9/1994 Oonuki et al. ..... 428/34.5
5,505,795 A 4/1996 Tsai et al.
5,647,807 A * 7/1997 Nagamoto ..... 473/305
5,795,243 A * 8/1998 Chang et al. ..... 473/310
5,885,170 A * 3/1999 Takeda ..... 473/306
6,004,224 A * 12/1999 Tanaka ..... 473/297
6,475,100 B1 11/2002 Helmstetter et al.
6,793,591 B2 * 9/2004 Takeda ..... 473/342
2001/0029208 A1 10/2001 Takeda
2002/0016217 A1 2/2002 Takeda et al.
2004/0116202 A1 * 6/2004 Lin ..... 473/306
2005/0064952 A1 3/2005 Chen et al.
2005/0176521 A1 * 8/2005 Burch et al. ..... 473/305

* cited by examiner

*Primary Examiner*—Stephen Blau
(74) *Attorney, Agent, or Firm*—Birch, Stewart, Kolasch & Birch, LLP

(57) ABSTRACT

A golf club head includes a golf club head body and a complex hosel. The golf club head body includes a neck portion located at a heel-side portion, and a connecting portion formed on the neck portion. The complex hosel is constructed from a one-piece tubular member made from a two-layer or multi-layer complex substrate combined along a longitudinal direction such that the complex hosel has at least one first tubular, segmental wall and at least one second tubular, segmental wall that possess two different characteristics of vibrational absorbability and elastic deformability. The complex hosel can provide different vibrational absorbability and elastic deformability characteristics in different radial directions of the neck portion of the golf club head body when assembled.

19 Claims, 5 Drawing Sheets

COMPLEX HOSEL STRUCTURE FOR A GOLF CLUB HEAD HAVING A HIGH DEGREE OF VIBRATIONAL ABSORBABILITY AND ELASTIC DEFORMABILITY

BACKGROUND OF THE INVENTION

1. Field of the Invention

The present invention relates to a complex hosel structure for a golf club head having a high degree of vibrational absorbability and elastic deformability. Particularly, the present invention relates to the complex hosel structure of the golf club head made from a two-layer complex substrate consisting of two different materials. More particularly, the present invention also relates to the complex hosel structure of the golf club head made from a multi-layer complex substrate consisting of at least two or three different materials.

2. Description of the Related Art

A conventional golf club head, as described in U.S. Pat. No. 4,995,609 entitled "Iron Golf Club Heads," generally includes a golf club head body and a striking plate attached thereto. Typically, the golf club head body has a neck portion adjacent to a heel portion. Formed at a position below both of the neck portion and the neck portion is a recess which can relatively reduce the entire weight of the golf club head body. Accordingly, a center of gravity of the golf club head body is naturally shifted along a direction toward a side of a toe portion (opposite to a side of the heel portion). This results in a relative extension of the moment of inertia of the golf club head. In striking a golf ball, the golf club head so configured and adjusted can advantageously enhance the striking ability as well as increasing a striking distance.

Although it would be advantageous to make the recess formed on the heel portion of the golf club head body, thereby shifting the center of gravity toward the toe portion, the thinner section of the recess are susceptible to permanent distortion and inefficiencies during striking the golf club ball. Another problem with the recess of the golf club head body is raising the center of gravity upwardly in addition to shifting toward the toe portion. The primary problem with such a higher center of gravity may disadvantageously cause a relatively high sweet spot of the striking plate. Consequently, the recess of the golf club head body may be impractical and cannot improve the striking ability, as it can be a broken or permanently distorted risk during striking the golf ball. It is important to note that the design of the recess of the golf club head body cannot effectively absorb striking vibrations upwardly transmitted through the neck portion to the club shaft. On the other hand, the recess of the golf club head body cannot substantially improve its elastic deformability of the neck portion due to such a design limitation of permanent distortion.

Another conventional golf club head, as described in U.S. Patent Application Publication No. 2005/0064952 entitled "Golf Club Heads," generally includes a golf club head body, a striking plate and a lightweight sleeve of a wrapping layer. Typically, the golf club head body has a neck portion adjacent to a heel portion. Formed on the neck portion of the golf club head body is a thin-diameter recessed section. It is advantageous that the thin-diameter recessed section of the neck portion of the golf club head body can achieve to reduce total weight, and to shift a center of gravity toward outwardly to the heel portion and downwardly to the sole portion. This results in a relative extension of the moment of inertia of the golf club head. In striking a golf ball, the golf club head so configured and adjusted can advantageously enhance the striking ability as well as increasing a striking distance. Correspondingly, formed on a front side of the golf club head body is a striking plate for striking a golf ball.

To accomplish a lower weight of the golf club head, the lightweight sleeve is made from a lightweight material to provide a low weight characteristic. In assembling, the lightweight sleeve surrounds the thin-diameter recessed section of the neck portion of the golf club head body. The lightweight sleeve can effectively enhance the structural strength of the golf club head body and absorb vibrations during striking the golf ball.

In general, the above-mentioned type of the golf club head has a number of design deficiencies, including the lightweight sleeve being only made from a single material that fails to possess a combination of characteristics of the lower center of gravity, higher vibrational absorbability and higher elastic deformability. Another design problem with manufacture of dimensions of the lightweight sleeve is the difficulty in precisely matching with dimensions of the thin-diameter recessed section of the golf club head body. To minimize a clearance between the lightweight sleeve and the thin-diameter recessed section of the golf club head body, the manufacturing operation has become difficult and sophisticated.

Another design problem with the lightweight sleeve is to provide uniform characteristics of vibrational absorbability and elastic deformability in each radial direction of the thin-diameter recessed section of the golf club head body. However, the design of the thin-diameter recessed section of the golf club head body requires the lightweight sleeve that possesses various vibrational absorbability and elastic deformability in its different radial direction according to the experimental results of the stress transmitting analysis. In other words, although it would be advantageous to install the lightweight sleeve on the thin-diameter recessed section of the golf club head body, thereby lowering the center of gravity, the one-piece member of the lightweight sleeve cannot provide various vibrational absorbability and elastic deformability in its different radial direction. Hence, there is a need for providing various vibrational absorbability and elastic deformability of the lightweight sleeve in its different radial direction for use in the golf club head according to the personal design need.

The present invention intends to provide a complex hosel structure employing two different materials for a golf club head. The complex hosel structure is constructed from a one-piece tubular member made from a two-layer or multi-layer complex substrate combined along a longitudinal direction such that the complex hosel structure has at least one first tubular, segmental wall and at least one second tubular, segmental wall. The first tubular, segmental wall of the complex hosel structure can provide a high-degree vibrational deformability characteristic while the second tubular, segmental wall can provide a high degree elastic deformability characteristic in such a way as to mitigate and overcome the above problem.

SUMMARY OF THE INVENTION

The primary objective of this invention is to provide a complex hosel structure employing two different materials for a golf club head, wherein the complex hosel structure is made from a two-layer or multi-layer complex substrate combined along a longitudinal direction. Accordingly, the complex hosel structure can provide a high-degree of vibrational absorbability and elastic deformability.

The secondary objective of this invention is to provide the complex hosel structure for the golf club head, wherein the two different materials are combined in an explosive welding or rolling procedure. The complex hosel structure is constructed from a one-piece tubular member formed in a milling procedure. Accordingly, the one-piece tubular member of the complex hosel structure can enhance the structural strength and be ease of manufacture.

The golf club head in accordance with an aspect of the present invention includes a golf club head body and a complex hosel. The golf club head body includes a neck portion located at a heel-side portion, and a connecting portion formed on the neck portion. The complex hosel is constructed from a one-piece tubular member made from a two-layer or multi-layer complex substrate combined along a longitudinal direction such that the complex hosel has at least one first tubular, segmental wall and at least one second tubular, segmental wall that possess two different characteristics of vibrational absorbability and elastic deformability. The complex hosel can provide different vibrational absorbability and elastic deformability characteristics in different radial directions of the neck portion of the golf club head body when assembled.

In a separate aspect of the present invention, the one-piece tubular member of the complex hosel is formed from two tubular halves made from two different materials.

In a further separate aspect of the present invention, the one-piece tubular member of the complex hosel is formed from the three-layer complex substrate made from two different materials.

In a yet further separate aspect of the present invention, the one-piece tubular member of the complex hosel is formed from the three-layer complex substrate made from three different materials.

In a yet further separate aspect of the present invention, the connecting portion of the neck portion is connected with a connecting portion of the complex hosel in a friction, TIG (Tungsten Insert Gas) or high-energy welding procedure.

In a yet further separate aspect of the present invention, one of the connecting portions of the golf club head body and the complex hosel is provided with a screw hole while one of the connecting portions of the complex hosel and the golf club head body is correspondingly provided with a screw rod.

In a yet further separate aspect of the present invention, one of the connecting portions of the golf club head body and the complex hosel is provided with an engaging rod while one of the connecting portions of the complex hosel and the golf club head body is correspondingly provided with an engaging hole.

In a yet further separate aspect of the present invention, the engaging rod is provided with at least one of guiding groove or rib while the engaging hole is correspondingly provided with at least one of guiding rib or groove.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1A:
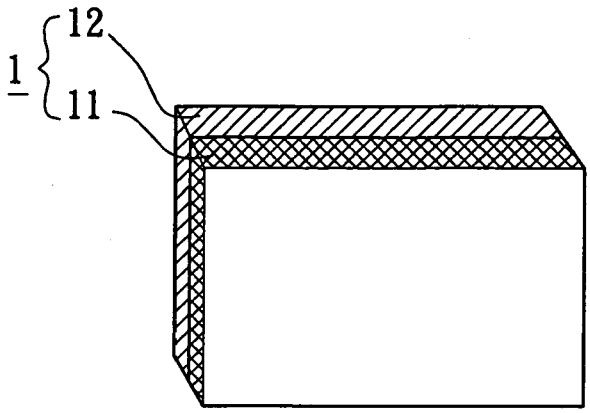
FIGS. 1A-1D are perspective views illustrating a manufacturing method applied to manufacture a complex hosel structure for a golf club head in accordance with a first embodiment of the present invention.
Figure 1B:
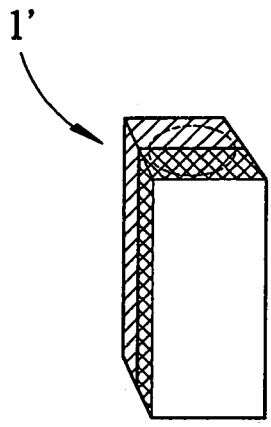
Figure 1C:
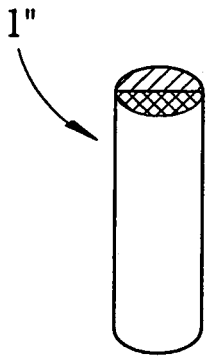
Figure 1D:
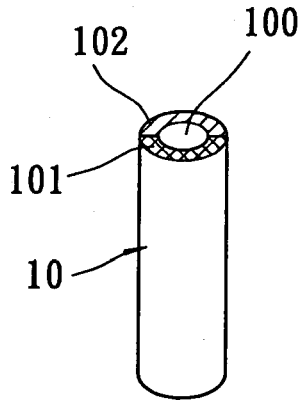

Referring to FIGS. 1 through 7, a manufacturing method for a complex hosel structure for a golf club head in accordance with the present invention is used to separately manufacture a complex hosel 10 and a golf club head body 20. Thus, the complex hosel 10 and the golf club head body 20 are assembled by suitable means such that the golf club head body 20 possesses different vibrational absorbability and elastic deformability characteristics by using such a complex hosel 10. Accordingly, mechanical requirements for a neck portion of all types of the golf club head bodies 20 are achieved. Consequently, the golf club head in accordance with the present invention performs a high degree of vibrational absorbability and elastic deformability.

With reference now to FIGS. 1A through 1D, perspective views of the manufacturing method applied to manufacture the complex hosel structure in accordance with a first embodiment of the present invention are illustrated. The manufacturing method for the complex hosel structure includes the steps of: combing a first plate 11 made from a first material with a second plate 12 made from a second material in an explosive welding procedure, a rolling procedure, adhering procedure or a combination thereof to form a complex material 1 of a two-layer plate; cutting the two-layer plate into pieces of complex substrates 1'; forming a one-piece cylindrical member 1" from the complex substrate 1'; providing a longitudinal through hole in the one-piece cylindrical member 1" to form a one-piece tubular member as well as the complex hosel 10 by a milling procedure.

Still referring to FIG. 1A, the first material 11 of the first plate and the second material 12 of the second plate are selected from different materials. For instance, the first material 11 of the first plate is made from a relatively high-degree Young's Modulus material selected from a group consisting of carbon steel, 17-4PH stainless steel, alloy steel, Fe—Mn—Al alloy, nickel-based alloy, cast iron, copper alloy, aluminum alloy and super alloy steel. Correspondingly, the second material 12 of the second plate is made from a relatively low-degree Young's Modulus material selected from a group consisting of stainless steel, carbon steel, copper alloy, aluminum alloy, Fe—Mn—Al alloy and titanium alloy. Conversely, the first material 11 of the first plate is made from a relatively low-degree Young's Modulus material while the second material 12 of the second plate is made from a relatively high-degree Young's Modulus material.

Referring back to FIG. 1D, when the complex hosel 10 is fabricated, the first material 11 of the first plate and the second material 12 of the second plate constitute a first tubular half 101 and a second tubular half 102 respectively. The first tubular half 101 and the second tubular half 102 are connected each other along a longitudinal direction (i.e., parallel to an axial direction) to constitute the complex hosel 10. In the first embodiment, the first tubular half 101 is designed to have dimensions substantially identical with those of the second tubular half 102. In a preferred embodiment, integrally formed between the first tubular half 101 and the second tubular half 102 is a welding layer or a rolled layer when the explosive welding or rolling procedure is applied. In an alternative preferred embodiment, formed between the first tubular half 101 and the second tubular half 102 is an adhesive layer when the adhering procedure is applied. The complex hosel 10 is provided with a hollow section 100 extended along the longitudinal direction. In a preferred embodiment, the hollow section 100 formed by the first tubular half 101 and the second tubular half 102 is designed to delimit one of a through hole or a blind hole according to the design needs.

Turning now to FIGS. 2A through 2D, perspective views of another manufacturing method applied to manufacture the complex hosel structure in accordance with a second embodiment of the present invention are illustrated. In the second embodiment, the manufacturing method for the complex hosel structure includes the steps of: inserting a first material 11 into a tubular member of a second material 12, and connecting the first material 11 and the second material 12 in an explosive welding procedure, a rolling procedure, adhering procedure or a combination thereof to form a complex material 1 of a two-layer cylindrical member; shaping the two-layer cylindrical member into an elliptic cylinder of a complex substrate 1'; forming a one-piece cylindrical member 1" with three layers from the elliptic cylinder of the complex substrate 1'; providing a longitudinal through hole in the one-piece cylindrical member 1" to form a one-piece tubular member as well as the complex hosel 10 by a milling procedure.

Figure 2A:
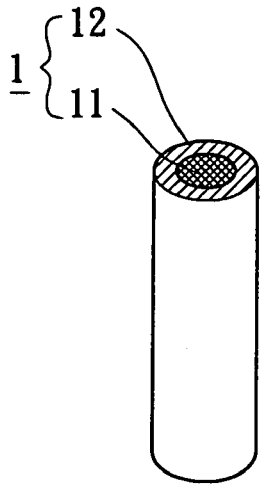
FIGS. 2A-2D are perspective views illustrating another manufacturing method applied to manufacture the complex hosel structure for the golf club head in accordance with a second embodiment of the present invention.
Figure 2B:
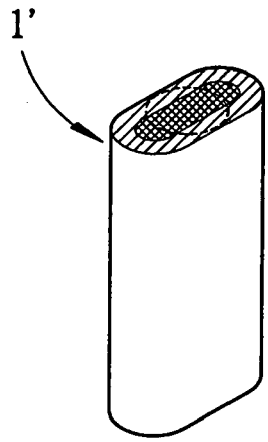
Figure 2C:
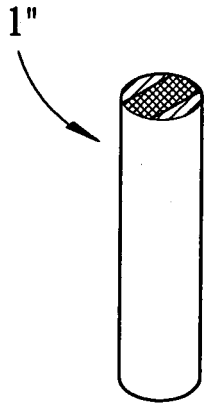
Figure 2D:
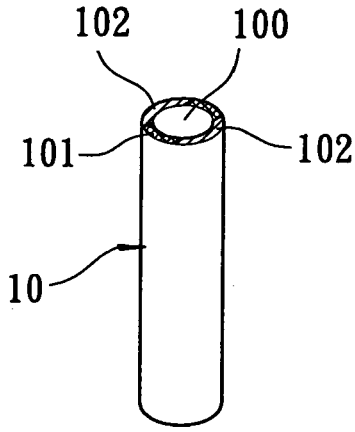

Still referring to FIG. 2A, the first material 11 of the first plate is made from a relatively high-degree Young's Modulus material while the second material 12 of the second plate is made from a relatively low-degree Young's Modulus material. Conversely, the first material 11 of the first plate is made from a relatively low-degree Young's Modulus material while the second material 12 of the second plate is made from a relatively high-degree Young's Modulus material.

Referring back to FIG. 2D, in comparison with the first embodiment, the first material 11 of the first plate and the second material 12 of the second plate of the second embodiment constitute a pair of first tubular, segmental walls 101' and a second tubular, segmental walls 102' respectively. The first tubular, segmental walls 101' and the second tubular, segmental walls 102' are alternated and connected along a longitudinal direction to constitute the complex hosel 10. In the second embodiment, a predetermined ratio of dimensions of the first tubular, segmental wall 101' to those of the second tubular, segmental wall 102' is designed. The complex hosel 10 is provided with a hollow section 100 extended along the longitudinal direction.

Figure 3:
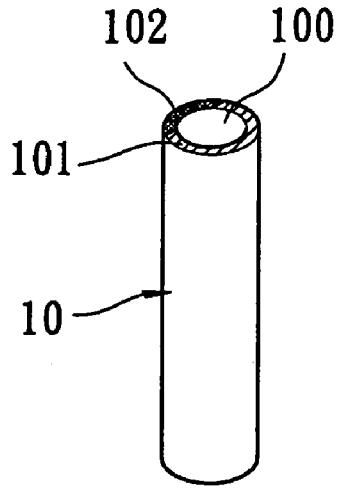
FIG. 3 is a perspective view illustrating a complex hosel structure for the golf club head in accordance with a third embodiment of the present invention.

Turning now to FIG. 3, a perspective view of the complex hosel structure for the golf club head in accordance with a third embodiment of the present invention is illustrated. In the third embodiment, the manufacturing method applied in the first and second embodiments can be used to fabricate the complex hosel 10. In comparison with the first and second embodiments, the first tubular half 101 of the third embodiment is designed to have dimensions different from those of the second tubular half 102. In a preferred embodiment, the dimensions of the first tubular half 101 is greater than those of the second tubular half 102. In an alternative preferred embodiment, the dimensions of the first tubular half 101 is smaller than those of the second tubular half 102.

Figure 4:
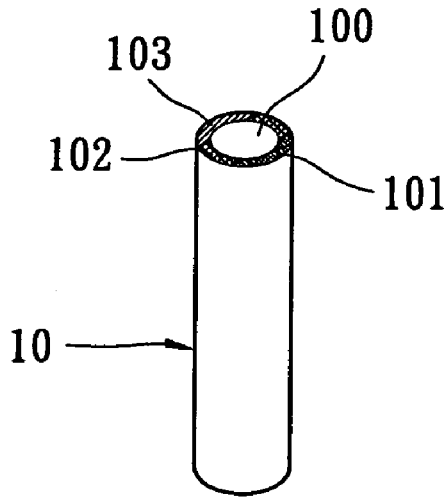
FIG. 4 is a perspective view illustrating a complex hosel structure for the golf club head in accordance with a fourth embodiment of the present invention.

Turning now to FIG. 4, a perspective view of the complex hosel structure for the golf club head in accordance with a fourth embodiment of the present invention is illustrated. In the fourth embodiment, the manufacturing method applied in the first and second embodiments can be used to fabricate the complex hosel 10. In comparison with the first through third embodiments, the complex hosel 10 of the fourth embodiment includes a first tubular, segmental wall 101", a pair of second tubular, segmental walls 102" and a third tubular, segmental wall 103" formed from three layers. In a preferred embodiment, dimensions of the first tubular, segmental wall 101", the second tubular, segmental wall 102" and the third tubular, segmental wall 103" are or are not all the same according to the personal design needs. In the fourth embodiment, the first tubular, segmental wall 101", the second tubular, segmental wall 102" and the third tubular, segmental wall 103" are made from three or more different materials.

In the following embodiments, the golf club head of the present invention can be selected from a group consisting of a wood-type club head, an iron-type club head, a utility-type club head and a putter-type club head. The description of the complex hosel structure of the golf club head in accordance with the present invention shall be only applied to the wood-type and iron-type club heads. It will be understood that the description of the complex hosel structure applied to the utility-type or putter-type club head in accordance with the present invention is omitted.

Figure 5:
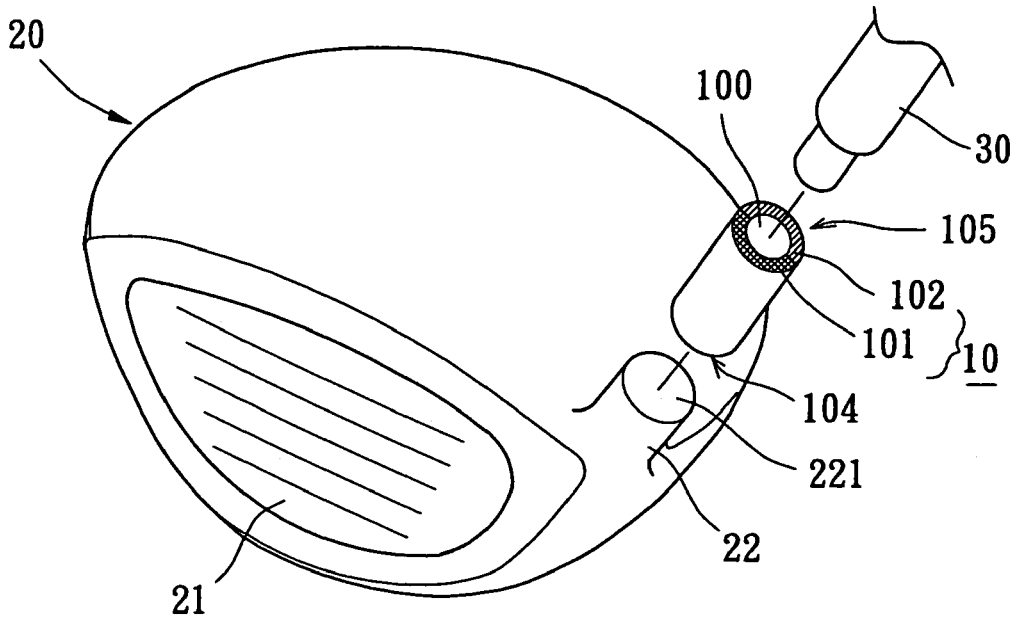
FIG. 5 is an exploded perspective view illustrating a golf club head body to combine with the complex hosel structure in accordance with a fifth embodiment of the present invention.
Figure 6:
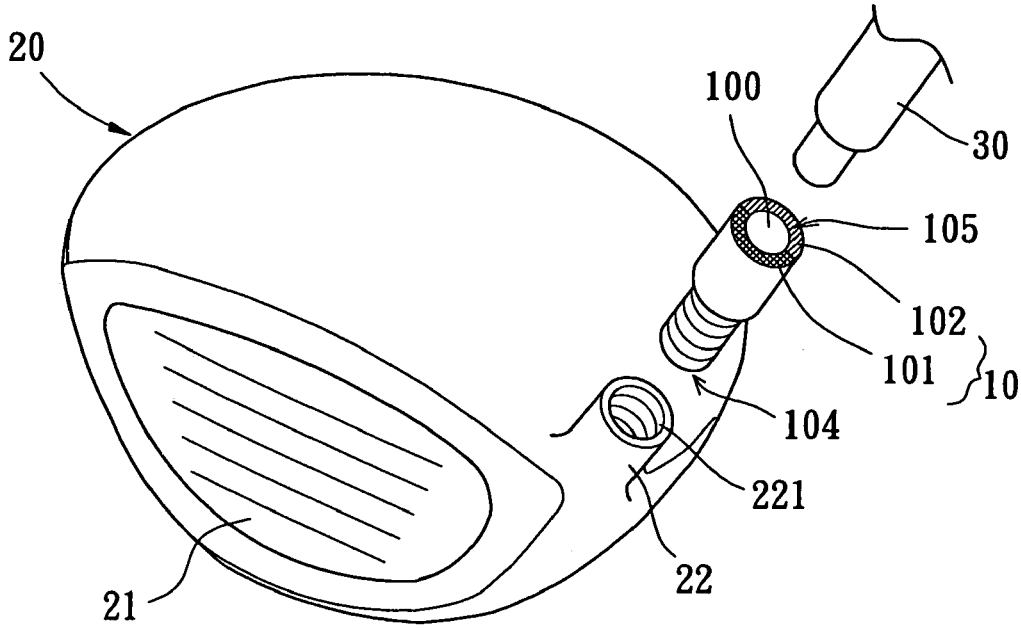
FIG. 6 is an exploded perspective view illustrating a golf club head body to combine with the complex hosel structure in accordance with a sixth embodiment of the present invention.
Figure 7:
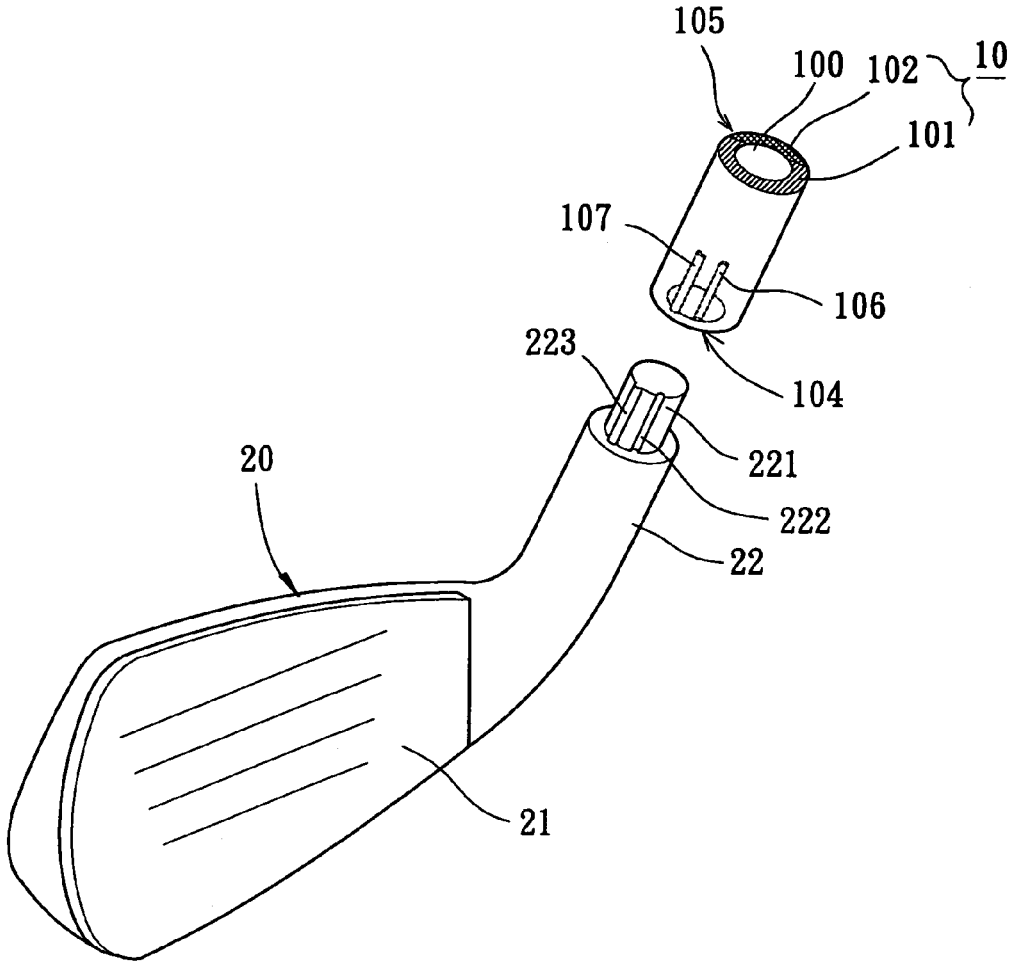
FIG. 7 is an exploded perspective view illustrating a golf club head body to combine with the complex hosel structure in accordance with a seventh embodiment of the present invention.

Turning now to FIGS. 5 through 7, various suitable connecting constructions for the complex hosel 10 and the golf club head body 20 in the following embodiments shall be described in detail. In FIG. 5, a first distal end of the complex hosel 10 of the fifth embodiment is provided with a first connecting portion 104 while a second distal end of the complex hosel 10 is provided with a second connecting portion 105. In assembling operation, the first connecting portion 104 is disposed at a bottom end of the complex hosel 10 and is adapted to engage with the golf club head body 20. Conversely, the second connecting portion 105 is disposed at a top end of the complex hosel 10 and is adapted to engage with a club shaft 30. Furthermore, the golf club head body 20 has an ordinary form selected from the wood-type, iron-type, utility-type or putter-type club head. In the fifth embodiment, a front side of the golf club head body 20 can be integrally or separately formed with a striking plate 21. Other portions of the golf club head body 20 substantially include a toe-side portion, a sole portion, a crown portion and a heel-side portion. In the preferred embodiment, the heel-side portion of the golf club head body 20 is designed to have a neck portion 22 on which to provide a connecting portion 221. Correspondingly, the first engaging portion 104 of the complex hosel 10 is designed to have a connecting portion.

Still referring to FIG. 5, all of the first connecting portion 104 of the complex hosel 10 and the connecting portion 221 of the neck portion 22 of the golf club head body 20 are prefabricated to form suitable welding surfaces which can be connected each other in a friction, TIG (Tungsten Insert Gas) or high-energy welding procedure if a correct alignment therebetween is ensured. Furthermore, an end of the club shaft 30 is engaged in the hollow section 100 located at the second connecting portion 105 of the complex hosel 10. Once assembled, the complex hosel 10 and the neck portion 22 of the golf club head body 20 are aligned with each other in an angled relationship. Accordingly, each orientation of the first tubular, segmental wall 101 and the second tubular, segmental wall 102 of the complex hosel 10 faces a predetermined radial direction of the neck portion 22 of the golf club head body 20 such that the first tubular, segmental wall 101 and the second tubular, segmental wall 102 of the complex hosel 10 can provide various degrees of vibrational absorbability and elastic deformability in the radial directions of the neck portion 22 of the golf club head body 20. In a preferred embodiment, the first tubular, segmental wall 101", the second tubular, segmental wall 102" and the third tubular, segmental wall 103" of the complex hosel 10 can provide various degrees of vibrational absorbability and elastic deformability in the radial directions of the neck portion 22 of the golf club head body 20, as best shown in FIG. 4.

Referring to FIG. 6, in the sixth embodiment, the connecting portion 221 of the golf club head body 20 is provided with a screw hole formed with an inner threaded portion while the first connecting portion 104 of the complex hosel 10 is correspondingly provided with a screw rod formed with an outer threaded portion. In an alternative embodiment, the screw hole disposed on the connecting portion 221 of the golf club head body 20 is interchanged with a screw rod while the screw rod disposed on the first connecting portion 104 of the complex hosel 10 is interchanged with a screw hole. Namely, the first connecting portion 104 of the complex hosel 10 can be provided with a screw rod while the connecting portion 221 of the golf club head body 20 can be correspondingly provided with a screw hole. Once assembled, the complex hosel 10 and the neck portion 22 of the golf club head body 20 are aligned with each other in an angled relationship. Accordingly, each orientation of the first tubular, segmental wall 101 and the second tubular, segmental wall 102 of the complex hosel 10 faces a predetermined radial direction of the neck portion 22 of the golf club head body 20 such that the first tubular, segmental wall 101 and the second tubular, segmental wall 102 of the complex hosel 10 can provide various degrees of vibrational absorbability and elastic deformability in the radial directions of the neck portion 22 of the golf club head body 20. In a preferred embodiment, each orientation of the first tubular, segmental wall 101", the second tubular, segmental wall 102" and the third tubular, segmental wall 103" of the complex hosel 10 faces a predetermined radial direction of the neck portion 22 of the golf club head body 20, as best shown in FIG. 4.

Turning now to FIG. 7, in the seventh embodiment, the golf club head body 20 is selected from the iron-type club head. The connecting portion 221 of the golf club head body 20 is provided with an engaging rod projected therefrom while the first connecting portion 104 of the complex hosel 10 is correspondingly provided with an engaging hole formed in the hollow section 100. In an alternative embodiment, the engaging rod disposed on the connecting portion 221 of the golf club head body 20 is interchanged with an engaging hole while the engaging hole disposed in the first connecting portion 104 of the complex hosel 10 is interchanged with an engaging rod. Namely, the first connecting portion 104 of the complex hosel 10 can be provided with an engaging hole while the connecting portion 221 of the golf club head body 20 can be correspondingly provided with an engaging rod. Once assembled, the complex hosel 10 and the neck portion 22 of the golf club head body 20 are aligned with each other in an angled relationship. Accordingly, each orientation of the first tubular, segmental wall (i.e. greater tubular, segmental wall) 101 and the second tubular, segmental wall (i.e. smaller tubular, segmental wall) 102 of the complex hosel 10 faces a predetermined radial direction of the neck portion 22 of the golf club head body 20 such that the first tubular, segmental wall (i.e. greater tubular, segmental wall) 101 and the second tubular, segmental wall (i.e. smaller tubular, segmental wall) 102 of the complex hosel 10 can provide various degrees of vibrational absorbability and elastic deformability in the radial directions of the neck portion 22 of the golf club head body 20. In a preferred embodiment, each orientation of the first tubular, segmental wall 101", the second tubular, segmental wall 102" and the third tubular, segmental wall 103" of the complex hosel 10 faces a predetermined radial direction of the neck portion 22 of the golf club head body 20, as best shown in FIG. 4.

In the seventh embodiment, the engaging rod of the neck portion 22 of the golf club head body 20 is further provided with at least one guiding groove 222 and at least one guiding rib 223 while the engaging hole of the first connecting portion 104 of the complex hosel 10 is correspondingly provided with at least one guiding rib 106 and at least one guiding groove 107. Once assembled, the correct orientations of the first tubular, segmental wall 101 and the second tubular, segmental wall 102 of the complex hosel 10 with respect to the golf club head body 20 is ensured, and any rotational movement of the complex hosel 10 about the neck portion 22 of the golf club head body 20 is avoided. Consequently, various predetermined degrees of vibrational absorbability and elastic deformability in the radial directions of the neck portion 22 of the golf club head body 20 can be selected according to the personal design choice.

It will be apparent from the aforementioned discussions that although it would be advantageous to install the lightweight sleeve on the thin-diameter recessed section of the golf club head body disclosed in U.S. Patent Application Publication No. 2005/0064952, thereby lowering the center of gravity, the one-piece member of the lightweight sleeve cannot provide various vibrational absorbability and elastic deformability in its different radial direction. Referring back to FIG. 5, the first tubular, segmental wall 101 and the second tubular, segmental wall 102 of the complex hosel 10 of the present invention can provide various degrees of vibrational absorbability and elastic deformability in the radial directions of the neck portion 22 of the golf club head body 20 according to the personal design choice.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A golf club head having a complex hosel structure, comprising:

a golf club head body including a striking plate, a toe-side portion, a sole portion, a crown portion and a heel-side portion, a neck portion located at the heel-side portion and a first connecting portion formed on the neck portion; and a complex hosel including a first tubular, segmental wall and a second tubular, segmental wall which are combined along a longitudinal direction parallel to an axial direction, the first tubular, segmental wall and the second tubular, segmental wall being made from a first material and a second material which are different, with a welding layer being formed between the first tubular, segmental wall and the second tubular, segmental wall, the complex hosel further including a second connecting portion;

wherein the first connecting portion of the golf club head body and the second connecting portion of the complex hosel are connected each other when assembled.

2. The golf club head having the complex hosel structure as defined in claim 1, wherein the first material is selected from a relatively low-degree Young's Modulus material while the second material is selected from a relatively high-degree Young's Modulus material.

3. The golf club head having the complex hosel structure as defined in claim 1, wherein dimensions of the first tubular, segmental wall is greater or smaller than those of the second tubular, segmental wall.

4. The golf club head having the complex hosel structure as defined in claim 1, wherein the first connecting portion of the golf club head body and the second connecting portion of the complex hosel are prefabricated to form welding surfaces which can be connected each other in a welding procedure.

5. The golf club head having the complex hosel structure as defined in claim 1, wherein one of the first connecting portion of the golf club head body and the second connecting portion of the complex hosel is provided with a screw hole while one of the first connecting portion of the complex hosel and the second connecting portion of the golf club head body is correspondingly provided with a screw rod.

6. The golf club head having the complex hoset structure as defined in claim 1, wherein the complex hosel including a hollow section to form a through hole or a blind hole.

7. The golf club head having the complex hosel structure as defined in claim 6, wherein one of the first connecting portion of the golf club head body and the second connecting portion of the complex hosel is provided with an engaging rod while one of the first connecting portion of the complex hosel and the second connecting portion of the golf club head body is correspondingly provided with an engaging hole.

8. The golf club head having the complex hosel structure as defined in claim 7, wherein the engaging rod is provided with at least one of guiding groove or rib while the engaging hole is correspondingly provided with at least one of guiding rib or groove.

9. The golf club head having the complex hosel structure as defined in claim 1, wherein the complex hosel further includes a connecting portion to connect with a club shaft.

10. A golf club head having a complex hosel structure, comprising:

a golf club head body including a striking plate, a toe-side portion, a sole portion, a crown portion and a heel-side portion, a neck portion located at the heel-side portion and a first connectin portion formed on the neck portion; and a complex hosel including a first tubular, segmental wall and a second tubular, segmental wall which are combined along a longitudinal direction parallel to an axial direction, the first tubular, segmental wall and the second tubular, segmental wall being made from a first material and a second material which are different, with dimensions of the first tubular, segmental wall being identical with those of the second tubular, segmental wall, the complex hosel further including a second connecting portion;

wherein the first connectin portion of the golf club head body and the second connecting portion of the complex hosel are connected each other when assembled.

11. The golf club head having the complex hosel structure as defined in claim 10, wherein a rolled layer is formed between the first tubular, segmental wall and the second tubular, segmental wall.

12. The golf club head having the complex hosel structure as defined in claim 10, wherein an adhesive layer is formed between the first tubular, segmental wall and the second tubular, segmental wall.

13. The golf club head having the complex hosel structure as defined in claim 10, wherein the first material is selected from a relatively low-degree Young's Modulus material while the second material is selected from a relatively high-degree Young's Modulus material.

14. The golf club head having the complex hosel structure as defined in claim 10, wherein the first connecting portion of the golf club head body and the second connecting portion of the complex hosel are prefabricated to form welding surfaces which can be connected each other in a welding procedure.

15. The golf club head having the complex hosel structure as defined in claim 10, wherein one of the first connecting portion of the golf club head body and the second connecting portion of the complex hosel is provided with a screw hole while one of the first connecting portion of the complex hosel and the second connecting portion of the golf club head body is correspondingly provided with a screw rod.

16. The golf club head having the complex hosel structure as defined in claim 10, wherein the complex hosel including a hollow section to form a through hole or a blind hole.

17. The golf club head having the complex hosel structure as defined in claim 16, wherein one of the first connecting portion of the golf club head body and the second connecting portion of the complex hosel is provided with an engaging rod while one of the first connecting portion of the complex hosel and the second connecting portion of the golf club head body is correspondingly provided with an engaging hole.

18. The golf club head having the complex hosel structure as defined in claim 17, wherein the engaging rod is provided with at least one of guiding groove or rib while the engaging hole is correspondingly provided with at least one of guiding rib or groove.

19. The golf club head having the complex hosel structure as defined in claim 10, wherein the complex hosel further includes a connecting portion to connect with a club shaft.

* * * * *